US007377747B2

(12) United States Patent
Lee

(10) Patent No.: US 7,377,747 B2
(45) Date of Patent: May 27, 2008

(54) TURBINE AIRFOIL WITH INTEGRATED IMPINGEMENT AND SERPENTINE COOLING CIRCUIT

(75) Inventor: Ching-Pang Lee, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 63 days.

(21) Appl. No.: 11/160,022

(22) Filed: Jun. 6, 2005

(65) Prior Publication Data

US 2006/0275118 A1 Dec. 7, 2006

(51) Int. Cl.
*F01D 5/08* (2006.01)

(52) U.S. Cl. ..... 416/97 R; 416/96 R

(58) Field of Classification Search ..... 416/97 R, 416/96 R, 97 A, 90 R
See application file for complete search history.

(56) References Cited

U.S. PATENT DOCUMENTS

| | | | | |
|---|---|---|---|---|
| 4,820,122 | A | 4/1989 | Hall et al. | |
| 4,820,123 | A | 4/1989 | Hall | |
| 5,062,768 | A | 11/1991 | Marriage | |
| 5,176,499 | A | 1/1993 | Damlis et al. | |
| 5,378,108 | A | 1/1995 | Zelesky | |
| 5,503,529 | A | 4/1996 | Anselmi et al. | |
| 6,164,913 | A | 12/2000 | Reddy | |
| 6,318,960 | B1 | 11/2001 | Kuwabara et al. | |
| 2002/0090298 | A1 | 7/2002 | Beeck et al. | |
| 2002/0176776 | A1* | 11/2002 | Parneix et al. | 416/97 R |
| 2003/0026698 | A1* | 2/2003 | Flodman et al. | 416/97 R |
| 2003/0133798 | A1 | 7/2003 | Dailey | |

FOREIGN PATENT DOCUMENTS

| | | |
|---|---|---|
| EP | 0913556 A | 5/1999 |
| GB | 1350424 A | 4/1974 |

* cited by examiner

*Primary Examiner*—Edward K. Look
*Assistant Examiner*—Dwayne J White
(74) *Attorney, Agent, or Firm*—Adams Intellectual Property Law, P.A.; William Scott Andes, Esq.

(57) ABSTRACT

An airfoil for a gas turbine engine includes a generally radially-extending first cooling channel disposed between pressure and suction sidewalls adjacent the leading edge of the airfoil, and a generally radially-extending second cooling channel disposed aft of the first cooling channel. The second cooling channel is closed off at an outer end thereof and is disposed in fluid communication with a forward inlet an inner end thereof. The first and second cooling channels are separated by a partition having a plurality of impingement holes therein. A generally axially extending end channel is disposed radially outward from the second cooling channel in fluid communication with the first cooling channel and with a dust hole disposed in the tip cap. The dust hole is sized to permit the exit of debris entrained in a flow of cooling air from the airfoil.

20 Claims, 2 Drawing Sheets

TURBINE AIRFOIL WITH INTEGRATED IMPINGEMENT AND SERPENTINE COOLING CIRCUIT

BACKGROUND OF THE INVENTION

This invention relates generally to gas turbine components, and more particularly to cooled turbine airfoils.

Cooling circuits inside modern high pressure turbine blades typically have two parallel cooling circuits adjacent to each other. A leading edge circuit is a single-pass radially outward flow passage with leading edge film cooling holes and a tip opening. A mid-chord and trailing edge circuit is a multiple-pass serpentine with film cooling holes exiting to the pressure side of the blade. The leading edge circuit and mid-chord circuit are commonly fed a coolant from the airfoil dovetail and split into two separated passages at the blade root. Being a single pass structure, the leading edge circuit can not efficiently utilize the full capacity of the coolant, which is typically compressor discharge air. The Coolant in the leading edge channel exits through the leading edge film holes and the tip hole. To provide sufficient escape area for the particles entrained in the coolant supply system, the tip openings take the form of relatively large "dust holes" for each cooling circuit. These dust holes typically are larger than the film cooling holes. Air exiting from the dust holes can not provide cooling to the blade as efficiently as the relatively smaller film cooling holes.

Accordingly, there is a need for an efficiently cooled airfoil having a small number of dust holes.

BRIEF SUMMARY OF THE INVENTION

The above-mentioned need is met by the present invention, which according to one aspect provides an airfoil for a gas turbine engine having a longitudinal axis, the airfoil including a root, a tip, a leading edge, a trailing edge, and opposed pressure and suction sidewalls, and including: a generally radially-extending first cooling channel disposed between the pressure and suction sidewalls adjacent the leading edge; and a generally radially-extending second cooling channel disposed aft of the first cooling channel. The second cooling channel is closed off at an outer end thereof and disposed in fluid communication with a forward inlet an inner end thereof A generally radially extending partition having a plurality of impingement holes is disposed between the first and second cooling channels. A generally axially extending end channel is disposed radially outward from the second cooling channel in fluid communication with the first cooling channel and with a first dust hole disposed in the tip cap. The first dust hole is sized to permit the exit of debris entrained in a flow of cooling air from the airfoil.

According to another aspect of the invention, a turbine blade for a gas turbine engine includes a dovetail adapted to be received in a disk rotatable about a longitudinal axis; a laterally-extending platform disposed radially outwardly from the dovetail; and an airfoil including a root, a tip, a leading edge, a trailing edge, and opposed pressure and suction sidewalls. The airfoil includes a generally radially-extending first cooling channel disposed between the pressure and suction sidewalls adjacent the leading edge; and a generally radially-extending second cooling channel disposed aft of the first cooling channel. The second cooling channel is closed off at an outer end thereof and disposed in fluid communication with a forward inlet an inner end thereof. A generally radially extending partition having a plurality of impingement holes is disposed between the first and second cooling channels. A generally axially extending end channel is disposed radially outward from the second cooling channel in fluid communication with the first cooling channel and with a first dust hole disposed in the tip cap. The first dust hole is sized to permit the exit of debris entrained in a flow of cooling air from the airfoil.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
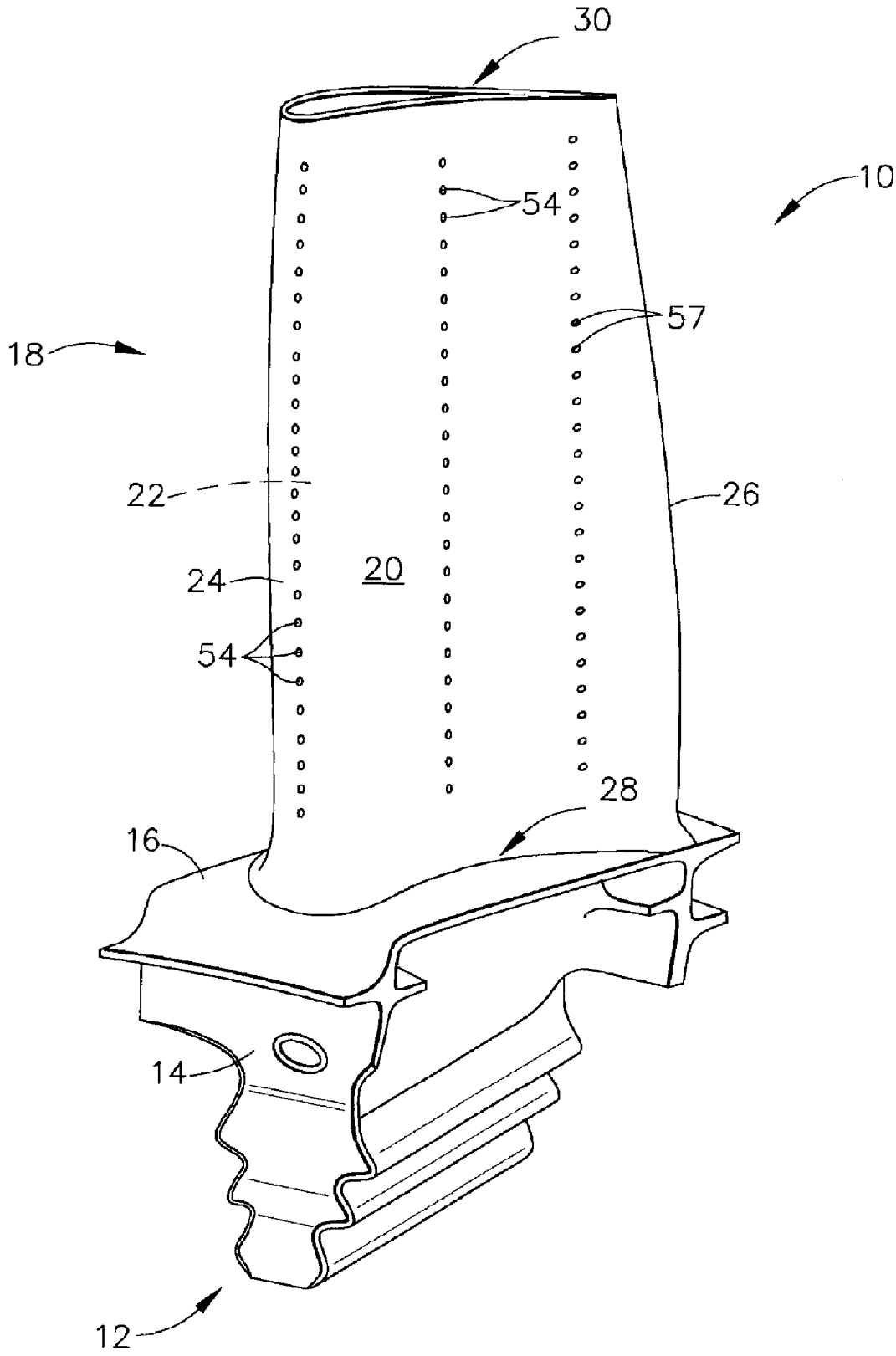
FIG. 1 is a perspective view of an exemplary turbine blade constructed according to the present invention.

Referring to the drawings wherein identical reference numerals denote the same elements throughout the various views, FIG. 1 illustrates an exemplary turbine blade 10. It should be noted that the present invention is equally applicable to other types of hollow cooled airfoils, for example stationary turbine nozzles. The turbine blade 10 includes a conventional dovetail 12, which may have any suitable form including tangs that engage complementary tangs of a dovetail slot in a rotor disk (not shown) for radially retaining the blade 10 to a disk as it rotates during operation. A blade shank 14 extends radially upwardly from the dovetail 12 and terminates in a platform 16 that projects laterally outwardly from and surrounds the shank 14. A hollow airfoil 18 extends radially outwardly from the platform 16 and into the hot gas stream. The airfoil 18 has a concave pressure sidewall 20 and a convex suction sidewall 22 joined together at a leading edge 24 and at a trailing edge 26. The airfoil 18 extends from a root 28 to a tip 30, and may take any configuration suitable for extracting energy from the hot gas stream and causing rotation of the rotor disk. The blade 10 may be formed as a one-piece casting of a suitable superalloy, such as a nickel-based superalloy, which has acceptable strength at the elevated temperatures of operation in a gas turbine engine. At least a portion of the airfoil is typically coated with a protective coating such as an environmentally resistant coating, or a thermal barrier coating, or both.

Figure 2:
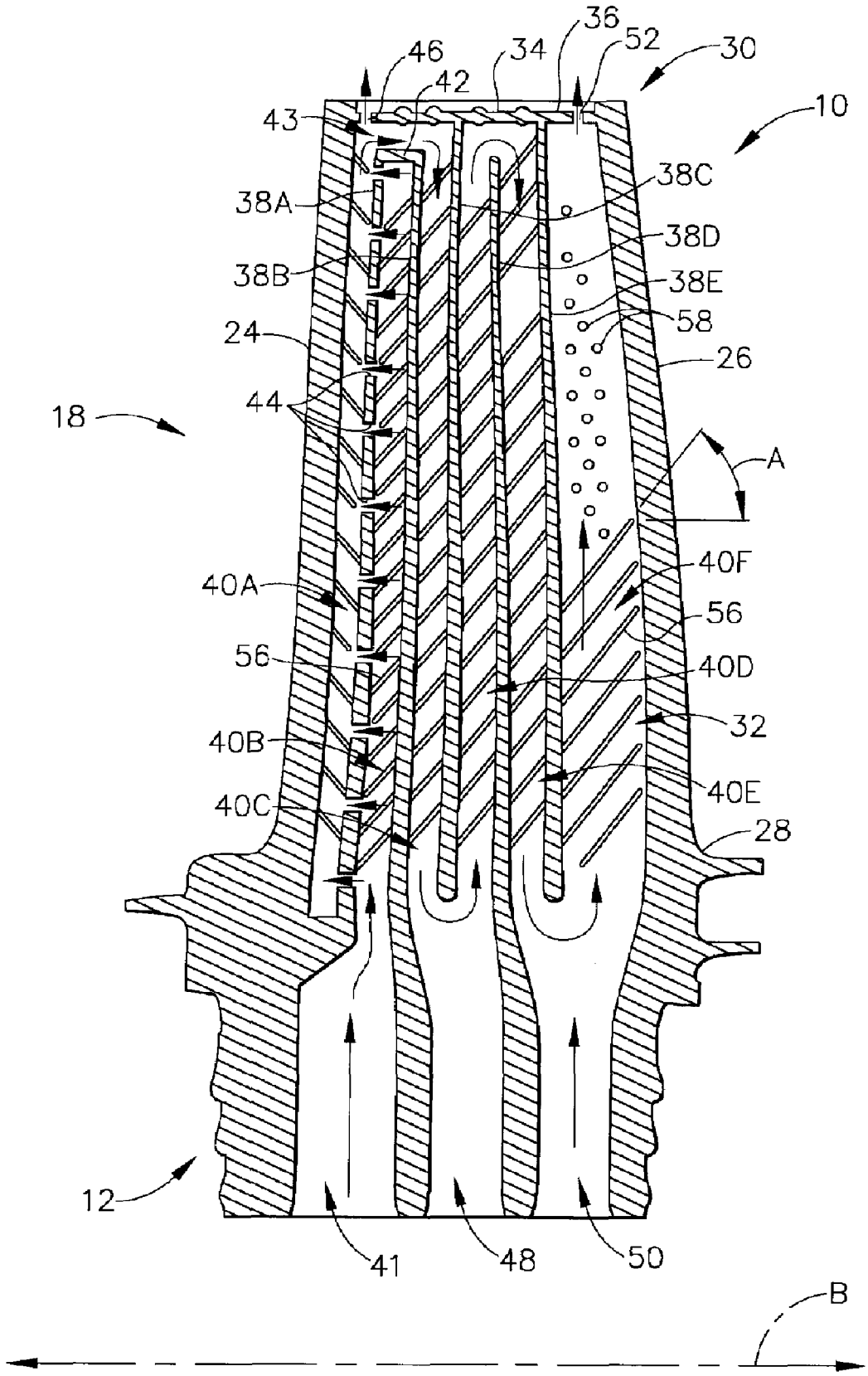
FIG. 2 is a cross-sectional view of the turbine blade of FIG. 1.

FIG. 2 illustrates the interior construction of the airfoil 18. The pressure and suction sidewalls 20 and 22 define a hollow interior cavity 32 within the airfoil 18, which is closed off near the tip 30 of the airfoil 18 by a tip cap 34. The tip cap 34 is recessed from the outer ends of the pressure and suction sidewalls 20 and 22 to define a "squealer tip" 36. A series of axially spaced-apart, generally radially extending partitions 38 spanning between the pressure and suction sidewalls 20 and 22 divides the interior cavity 32 into a series of generally radially-extending cooling channels 40.

A first partition 38A is disposed just aft of the leading edge 24 to define a first cooling channel or leading edge channel 40A. A second cooling channel 40B is defined between the first partition 38A and a second partition 38B, and extends from a forward inlet 41 in the dovetail 12 most of the distance to the tip cap 34. The second cooling channel 40B is closed off with an end wall 42 spaced a short distance from the tip cap 34 to define an end channel 43 between the end wall 42 and the tip cap 34.

A series of impingement holes 44 are formed through the first partition 38A. The impingement holes 44 are sized to produce jets of cooling air which impact against the leading edge 24.

A first opening referred to as a "dust hole" 46 is formed through the tip cap 34 in fluid communication with the leading edge channel 40A. The first dust hole 46 has a size large enough to permit escape of dust and other solid debris. In the illustrated example, the dust hole has a diameter of about 0.64 mm (0.025 in.) or greater.

The remainder of the interior cavity 32 aft of the second cooling channel 40B is partitioned into additional cooling channels 40 which may be configured in a known manner into one or more cooling circuits for cooling the blade by internal convection. In the example illustrated in FIG. 2, partitions 38C, 38D and 38E define a sequential series of radial cooling channels 40 arranged in a four-pass serpentine cooling circuit in the mid-chord region of the airfoil 18. A third cooling channel 40C extends radially inwardly from tip 30 to root 28 of the blade 10, and connects to a fourth cooling channel 40D which extends radially outwardly from root 28 to tip 30. An optional mid-chord inlet 48 may be provided to supply additional coolant to the fourth cooling channel 40D.

A fifth cooling channel 40E connects to the fourth cooling channel 40 and extends radially inwardly from tip 30 to root 28 of the blade 10, and a sixth cooling channel or trailing edge channel 40F connects to the fifth cooling channel 40 and extends outwardly from root 28 to tip 30. An optional trailing edge inlet 50 supplies additional coolant at lower temperature and higher pressure than the relatively "spent" coolant to the sixth cooling channel 40F. A second opening referred to as a "dust hole" 52 is formed through the tip cap 34 in fluid communication with the trailing edge channel 40F. The second dust hole 52 has a size large enough to permit escape of dust and other solid debris. In the illustrated example, the dust hole has a diameter of about 0.64 mm (0.025 in.) or more.

A plurality of film cooling holes 54 of a known type may optionally be formed through the at the leading edge 24 and/or the pressure sidewall 20. The film cooling holes 54 are disposed in fluid communication with the cooling channels 40 and receive pressurized coolant and discharge it in a protective sheet or film over the surface of the airfoil 18. In the illustrated example, an additional row of film cooling holes 57 are formed through the pressure sidewall 20 in fluid communication with the trailing edge channel 40F.

A plurality of raised turbulence promoters or "turbulators" 56 may be disposed on one or both of the suction sidewall 22 and pressure sidewall 20. The turbulators 56 are arrayed in longitudinal columns in one or more of the cooling channels 40. The turbulators 56 are disposed at an angle "A" to the longitudinal axis "B" of the blade 10. The angle A may be approximately 30 to 60 degrees, and is about 45 degrees in the illustrated example. The size, cross-sectional shape, and spacing of the turbulators 56, may be modified to suit a particular application. The trailing edge channel 40F may include other cooling or turbulence promoting features, such as the illustrated bank of circular-section pins 58, in addition to or in lieu of the turbulators 56.

In operation, relatively low-temperature coolant is supplied to the interior cavity 32 through the forward inlet 41. For example, compressor discharge air may be used for this purpose. The cooling air enters from the root of the second cooling channel 40B and impinges on the leading edge 24 through the impingement holes 44 in the first partition 38A. The post impingement air flows radially to the tip 30 through the first cooling channel 40 and makes a 90-degree turn above the second cooling channel 40B. Any entrained dust or other foreign objects substantially more dense than air will not be able to make the turn at high velocity and will thus exit the tip cap 34 through the first dust hole 46. The air then enters into the above-described serpentine cooling circuit at the tip of the third cooling channel 40C to circulate the cooling air through the rest of the airfoil 18. In this design, only a single dust hole 46 is required for the first, second, and third channels 40A, 40B, and 40C, respectively. This substantially reduces the coolant usage and improves efficiency compared to prior art airfoils which require individual dust holes for each cooling channel.

In the third cooling channel 40C, the coolant flows radially inwardly from tip to root of the blade 10, and in the fourth cooling channel 40D the coolant flows radially outwardly from root to tip upon reversing direction at the airfoil root 28. In the fifth cooling channel 40E, the coolant flows radially inwardly from tip to root of the blade 10 upon reversing direction at the airfoil tip 30, and in the sixth cooling channel or trailing edge channel 40F the coolant flows radially outwardly from root to tip upon reversing direction at the airfoil root 28. The cooling air is channeled through pins 58 if present The staggered array of pins 58 induces turbulence into the cooling air and facilitates convective cooling of the airfoil 18. The cooling air exits pins 36 and the exits the airfoil 18 through the second dust hole 52, and from the film cooling holes 57.

The foregoing has described a cooled airfoil for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. An airfoil for a gas turbine engine having a longitudinal axis, said airfoil including a root, a tip, a leading edge, a trailing edge, and opposed pressure and suction sidewalls, and comprising:

a generally radially-extending first cooling channel disposed between said pressure and suction sidewalls adjacent said leading edge;

a generally radially-extending second cooling channel disposed aft of said first cooling channel, said second cooling channel being closed off at an outer end thereof and disposed in fluid communication with a forward inlet an inner end thereof;

a generally radially extending partition having a plurality of impingement holes disposed between said first and second cooling channels; and a generally axially extending end channel disposed radially outward from said second cooling channel in fluid communication with said first cooling channel and with a first dust hole disposed in said tip cap, said first dust hole sized to permit the exit of debris entrained in a flow of cooling air from said airfoil.

2. The airfoil of claim 1 further comprising a plurality of generally radially-extending additional cooling channels disposed in said interior cavity and arranged to form an alternating inward and outward flowing serpentine flowpath.

3. The airfoil of claim 2 wherein:

one of said additional cooling channels is disposed adjacent said trailing edge to define a trailing edge cooling channel; and a second dust hole is disposed in said tip cap in fluid communication with said trailing edge cooling channel.

4. The airfoil of claim 1 further comprising a plurality of elongated raised turbulators disposed in at least one of said cooling channels along at least one of said pressure and suction sidewalls, said turbulators oriented at an angle to a longitudinal axis of said airfoil.

5. The airfoil of claim 4 wherein said turbulators are disposed at an angle of about 30 to about 60 degrees to said longitudinal axis.

6. The airfoil of claim 1 further comprising a plurality of pins disposed in at least one of said cooling channels and extending between said pressure and suction sidewalls.

7. The airfoil of claim 1 further comprising at least one film cooling hole disposed in said pressure sidewall in flow communication with said interior cavity.

8. The airfoil of claim 1 further including at least one additional inlet extending between said root and said interior cavity.

9. The airfoil of claim 8 wherein:

one of said additional cooling channels is disposed adjacent said trailing edge to define a trailing edge cooling channel; and said additional inlet is disposed in fluid communication with said trailing edge cavity.

10. The airfoil of claim 1 wherein said dust hole is about 0.64 mm or greater in diameter.

11. A turbine blade for a gas turbine engine, comprising:

a dovetail adapted to be received in a disk rotatable about a longitudinal axis;

a laterally-extending platform disposed radially outwardly from said dovetail; and an airfoil including a root, a tip, a leading edge, a trailing edge, and opposed pressure and suction sidewalls, said airfoil comprising:

a generally radially-extending first cooling channel disposed between said pressure and suction sidewalls adjacent said leading edge;

a generally radially-extending second cooling channel disposed aft of said first cooling channel, said second cooling channel being closed off at an outer end thereof and disposed in fluid communication with a forward inlet an inner end thereof;

a generally radially extending partition having a plurality of impingement holes disposed between said first and second cooling channels; and a generally axially extending end channel disposed radially outward from said second cooling channel in fluid communication with said first cooling channel and with a first dust hole disposed in said tip cap, said first dust hole sized to permit the exit of debris entrained in a flow of cooling air from said airfoil.

12. The turbine blade of claim 11 further comprising a plurality of generally radially-extending additional cooling channels disposed in said interior cavity and arranged to form an alternating inward and outward flowing serpentine flowpath.

13. The turbine blade of claim 12 wherein:

one of said additional cooling channels is disposed adjacent said trailing edge to define a trailing edge cooling channel; and a second dust hole is disposed in said tip cap in fluid communication with said trailing edge cooling channel.

14. The turbine blade of claim 11 further comprising a plurality of elongated raised turbulators disposed in at least one of said cooling channels along at least one of said pressure and suction sidewalls, said turbulators oriented at an angle to a longitudinal axis of said airfoil.

15. The turbine blade of claim 14 wherein said turbulators are disposed at an angle of about 30 degrees to about 60 degrees to said longitudinal axis.

16. The turbine blade of claim 11 further comprising a plurality of pins disposed in at least one of said cooling channels and extending between said pressure and suction sidewalls.

17. The turbine blade of claim 11 further comprising at least one film cooling hole disposed in said pressure sidewall in flow communication with said interior cavity.

18. The turbine blade of claim 11 further including at least one additional inlet extending between said dovetail and said interior cavity.

19. The turbine blade of claim 18 wherein:

one of said additional cooling channels is disposed adjacent said trailing edge to define a trailing edge cooling channel; and said additional inlet is disposed in fluid communication with said trailing edge cavity.

20. The turbine blade of claim 11 wherein said dust hole is about 0.64 mm or greater in diameter.

* * * * *